US006812836B2

(12) United States Patent
Soloway et al.

(10) Patent No.: US 6,812,836 B2
(45) Date of Patent: Nov. 2, 2004

(54) ALARM SYSTEM ARMED AND DISARMED BY A DOOR CONTACT

(75) Inventors: Richard L. Soloway, Amityville, NY (US); Jorge D. Hevia, Amityville, NY (US); Thomas F. Karl, Amityville, NY (US); Michael A. Carrieri, Amityville, NY (US); Charles S. Buccola, Amityville, NY (US)

(73) Assignee: Napco Security Systems, Inc., Amityville, NY (US)

( * ) Notice: Subject to any disclaimer, the term of this patent is extended or adjusted under 35 U.S.C. 154(b) by 53 days.

(21) Appl. No.: 10/290,026

(22) Filed: Nov. 7, 2002

(65) Prior Publication Data

US 2004/0090327 A1 May 13, 2004

(51) Int. Cl.[7] ..... E05B 45/06

(52) U.S. Cl. ..... 340/542; 340/825; 340/3.1; 340/3.22; 340/3.8; 340/5.2; 340/545.1; 340/825.37; 70/286; 70/432

(58) Field of Search ..... 340/542, 825, 340/3.1, 3.22, 3.42, 3.43, 3.7, 3.8, 3.9, 825.22, 5.2, 5.31, 825.36, 825.37, 545.1, 430; 70/286, 434, 432

(56) References Cited

U.S. PATENT DOCUMENTS

| | | | | |
|---|---|---|---|---|
| 4,189,692 | A | 2/1980 | Bonnar | |
| 4,370,644 | A | 1/1983 | Droz | |
| 4,667,183 | A | 5/1987 | Gaudio | |
| 4,689,610 | A | 8/1987 | Dietrich | |
| 4,845,471 | A | 7/1989 | Chu | |
| 4,920,333 | A | 4/1990 | Barr et al. | |
| 4,937,560 | A | 6/1990 | Nourmand | |
| 5,268,671 | A | 12/1993 | Novotny | |
| 5,311,168 | A | 5/1994 | Pease, Jr. et al. | |
| 5,370,201 | A | 12/1994 | Inubushi | |
| 5,428,345 | A | 6/1995 | Bruno | |
| 5,434,556 | A | 7/1995 | Donohoo | |
| 5,539,378 | A | 7/1996 | Chang | |
| 5,801,625 | A | 9/1998 | Wang | |
| 5,805,064 | A | 9/1998 | Yorkey | |
| 5,925,861 | A | 7/1999 | Fromberg | |
| 5,977,873 | A | 11/1999 | Woods | |
| 6,097,106 | A | 8/2000 | Roddy et al. | |
| 6,225,903 | B1 * | 5/2001 | Soloway et al. | 340/542 |

OTHER PUBLICATIONS

Aleph International, Reed Switches—Http://www.aleph–usa.com/rs_main.asp, 1999–2003.*

* cited by examiner

*Primary Examiner*—Jeffery Hofsass
*Assistant Examiner*—Jennifer Stone
(74) *Attorney, Agent, or Firm*—John R. Mugno

(57) ABSTRACT

A security alarm system that may be selectively armed or disarmed when monitoring a protective premises is described which utilizes the position of an entry door to determine whether the security system should be armed or disarmed. The security system comprises (i) an entry door for permitting ingress to the protected premises from the outside of the entry door and egress from the protected premises from the inside of the door; (ii) means for selectively closing and opening the entry door; and (iii) a switch having a first state indicative of the entry door being in a closed position and a second state indicative of the entry door being in an open position wherein, when the switch is in its first state, the security system is armed and, when the switch is in its second state, the security system is disarmed. The disabling of inadvertent (false) alarms is easily, yet securely achieved by activating a first user-controlled disarming means consisting of a kill switch, a keyfob, a telephone keypad coupled to a DTMF decoder, a keypad, an electronic coded digital key, or other means.

68 Claims, 2 Drawing Sheets

ALARM SYSTEM ARMED AND DISARMED BY A DOOR CONTACT

FIELD OF INVENTION

This invention is generally directed to residential and commercial alarm systems which are selectively armed and disarmed by a user. More specifically, the security alarm system of the present invention utilizes a door contact that is able to determine whether an entry door is opened or closed. The security alarm system of the present invention will arm (or turn ON) when the door contact indicates that the entry door is in a closed position, and disarm (or shut OFF) when the door contact indicates that the entry door is in an opened position.

BACKGROUND OF THE INVENTION

Burglaries, and the perceived risk thereof, have continually increased, particularly in crowded urban areas. Thus, more and more businesses and homes are protected by alarm systems. Most alarm systems comprise an alarm control panel; a series of detectors, sensors and/or door/perimeter contacts; and a user-controlled keypad. An alarm control panel typically includes all the necessary wiring and processing capable to determine whether signal information received from the detectors, sensors, contacts, etc. is indicative of an intruder. In more modern systems, the alarm control panel also provides the means for securing the telephone line (whether wireless or hardwired) in the house and dialing out to a central monitoring station if the processed signals are indicative of an intruder. A central monitoring station will then typically call the owner of the premises and, unless a proper secret code is provided, dispatch the police. The initial telephone call to the owner is not required but is usually done to confirm that the signal indicative of an alarm condition is not, instead, a false alarm. In certain municipalities, signals from the control panel may be sent directly to the police department or other municipal branch.

In the early prior art, the provided keypad was often utilized for both installation and operational programming functions, and to permit a user to arm or disarm the alarm system. However, the programming of an installed alarm system is increasingly conducted via downloading directly to the alarm control panel from a hand-held device or from a remote location using a telephone connection. Thus, the keypad is often little more than a complicated and expensive "ON/OFF" switch.

In conventional alarm systems, when a user is ready to exit the premises and desires the alarm system to be turned ON (i.e., armed), a unique user code will be punched into the keypad. Typically, a delay is set that allows sufficient time for the user to exit the premises through the access (or entry) door without setting off a false alarm. Conversely, when entering the premises, the user again must punch in a preselected code, utilizing the keypad, to disarm the alarm system. Again, a delay time is typically provided. If a user forgets or incorrectly inputs the preselected code and the delay time expires, an alarm condition will be initiated. Typically, an alarm condition will result in both an audio indication (such as a siren) and notification (via the telephone lines) to a central monitoring station.

Conventional keypad security systems are viewed unfavorably by users for a multiplicity of reasons. First, users need to remember their specific code and keep it secret. In order to permit authorized visitors access for a limited period of time (such as a house guest), a home or business owner must provide the access code yet would later need to change it to maintain security. Additionally, users often experience anxiety with the delay time permitted to enter a proper authorization code when either entering or exiting the premises. Many users, particularly elderly users, often lack the manual dexterity or the ability to view the keypad required to properly enter the pre-established code. All of these shortcomings result in unnecessary false alarms that occur during the simple process of entering or exiting the premises.

Soloway et al. U.S. Pat. No. 6,225,903 entitled ALARM SYSTEM ARMED AND DISARMED BY A DEADBOLT ON A DOOR, which is assigned to NAPCO Security Systems, Inc. (the same assignee as the present invention) solved the aforementioned difficulties with respect to entry doors that incorporated a deadbolt, latch, or the like. In essence, the alarm system would become armed when the deadbolt (or latch) was engaged and disarmed when the deadbolt (or latch) was retracted. U.S. Pat. No. 6,225,903 is hereby incorporated herein by this reference.

It has been shown that consumers particularly appreciate the "passive" means of disabling the alarm system as set forth in U.S. Pat. No. 6,255,903 wherein the retraction of the deadbolt or latch itself disarms the security system. Regrettably, many consumers who desire this passive disarming alarm system either do not utilize a deadbolt or, because they trust their alarm monitoring company so implicitly, fail to properly engage the deadbolt when exiting the premises.

It is therefore a primary object of the present invention to provide a new and improved security alarm system.

It is another object of the present invention to provide a new and improved security alarm system that can be armed and disarmed based on the position of an entry door.

It is yet still another object of the present invention to provide a new and improved security alarm system that is totally programmable without the utilization of a keypad, if desired.

It is still another object of the present invention to provide a new improved security alarm system which is armed and disarmed dependent upon the position of an entry door, and which is further tamper proof.

Other objects and advantages of the present invention will become apparent from the specification and the drawings.

SUMMARY OF THE INVENTION

Briefly stated, and in accordance with the preferred embodiments of the present invention, a security alarm system which may be selectively armed or disarmed when monitoring a protected premises is described which utilizes the position of an entry door (as either closed or opened) to determine whether the security system should be armed or disarmed. The security system comprises (i) an entry door for permitting ingress to the protected premises from the outside of the entry door and egress from the protected premises from the inside of the entry door; (ii) means for selectively closing an opening the entry door; and (iii) a door contact having a first state indicative of said entry door being in a closed position and second state indicative of said entry door being in an open position wherein, when said door contact is in said first state, said security system is armed and, when said door contact is in said second state, said security system is disarmed. The door contact utilized in the present invention can constitute a magnetic door contact (comprising a magnet and reed switch), an electron beam, or any other commonly utilized contacts which enable a user to determine if an entry door is in an opened or closed position. Additionally, while the contact (or switch) is described in the preferred embodiment as having one half the contact on the entry door and the other half of the door contact on the door frame, it would also be apparent to those skilled in the art that the door contact can have one half on the door and the other half placed on the floor beneath the door. Furthermore, the door contact can be placed on the top, bottom or sides of the entry door.

The preferred embodiment of the present invention also is described utilizing a "passive" disabling means and an "active" enabling means for the security alarm system. However, the apparatus and method described herein is equally effective in a security alarm system which allows for both passive arming and passive disarming of the security system.

The control unit described in conjunction with the preferred embodiment of the present invention permits the security alarm system to determine if the security alarm system was armed with authorized persons remaining inside the protected premises or whether no one remains in the secured premises. In the former situation, only external sensors and detectors will be activated, whereas in the latter situation, both internal (i.e., interior) and external (i.e., perimiter) sensors and detectors will be activated. Additionally, the command unit described in conjunction with the preferred embodiment permits for easy disabling of an inadvertent alarm and the entry of a special mode when a user loses his key, access card, or other means for locking and unlocking an entry door.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
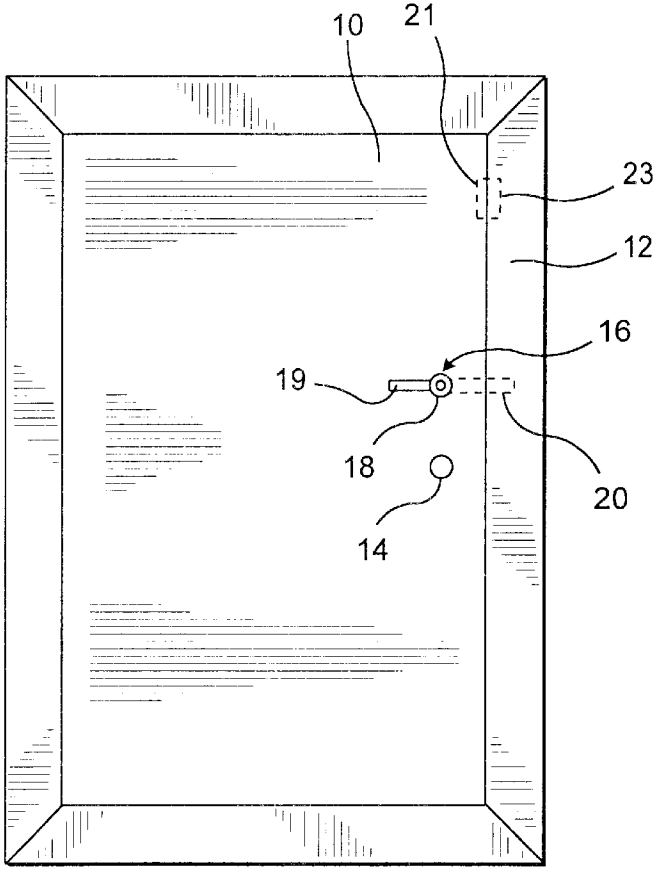
FIG. 1 is a schematic illustration of the outside of a secured entry door incorporating the security alarm system in accordance with the present invention.

Referring first to FIG. 1, a standard entry door 10 is shown which is hinge-mounted in a doorframe 12. A door handle 14 (depicted as a door knob) is on door 10 as well as a deadbolt lock assembly 16, in this instance. Deadbolt lock assembly 16 includes a key chamber 18 which receives a key 19 and is operably connected to a bolt 20. Bolt 20 is operable to either retract within door 10 in its unlocked position or to extend from door 10 through a deadbolt hole on doorframe 12 in its locked position. FIG. 1 visually appears no different than the outside of any door incorporating a deadbolt lock assembly.

A door contact is comprised of magnet 21 and switch 23. Magnet 21 is placed on door 10 and switch 23 is placed on doorframe 12. When magnet 21 and switch 23 are in alignment a signal can be issued indicative of the door being in a closed position. Conversely, when magnet 21 and switch 23 are not aligned, a signal can be issued indicative of entry door 10 being in an opened position. The signal issued from the door contact will be used to determine if the alarm security system should be armed or disarmed.

Figure 2:
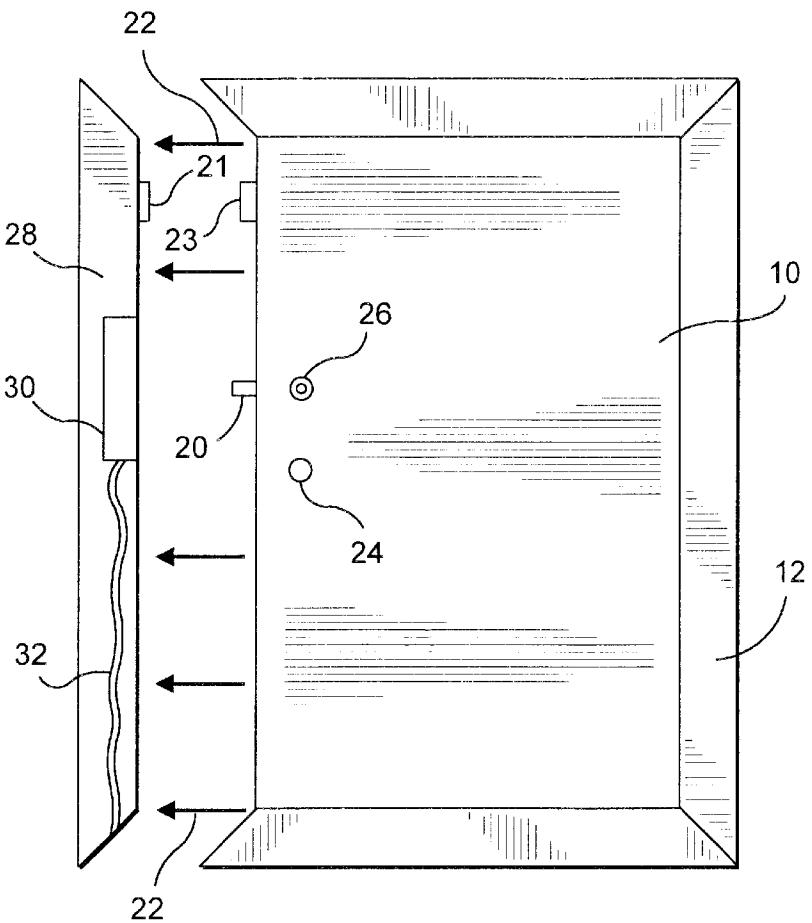
FIG. 2 is a schematic illustration of the inside of the secured entry door incorporating the security alarm system in accordance with the present invention.

Turning next to FIG. 2, the inside (or secured side) of entry door 10 and doorframe 12 is illustrated. The left side of doorframe 12 is shown exploded outwardly in the direction of directional arrows 22 in order to more clearly view magnet 21 and switch 23 of the door contact. Entry door 10 can be either opened or closed by a user by utilizing a door handle 24. However, other means for opening and closing entry door 12 can be utilized including nothing more than a person pushing or pulling the door opened and closed. The left panel 28 of doorframe 12 includes a sensor command unit 30 which is hardwired to a power source by means of wires 32. Sensor command unit 30 is more easily viewed in FIG. 3. While, in the preferred embodiment of the present invention, sensor command unit is placed on doorframe 28, it may also be placed on a nearby wall or any other convenient location.

Figure 3:
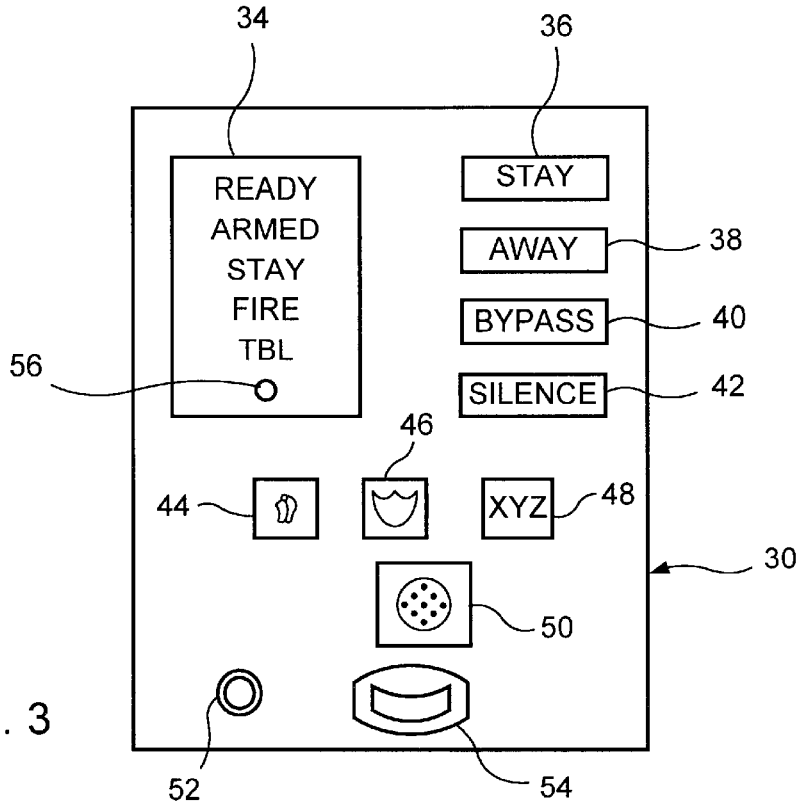
FIG. 3 is a schematic illustration of a preferred sensor command unit utilized in conjunction with the security alarm system in accordance with the present invention.

In the preferred embodiment of the present invention, sensor command unit 30 will include an illuminated display 34, a STAY button 36, an AWAY button 38, a BYPASS button 40, a SILENCE button 42, a fire emergency button 44, a police emergency button 46, an auxiliary emergency button 48 (that is typically wired to the central monitoring station), a siren 50, an electronic keyhole 52, and a motion sensor 54. As visible from FIG. 3, illuminated display 34 includes readable displays that state READY, ARMED, STAY, FIRE, TBL, and includes a light emitting diode (LED) 56. While many of the components shown in FIG. 3 are indeed optional, they have proven to provide the preferred means of practicing the present invention.

The operation of the security alarm system described in this preferred embodiment allows for simple operation of the system by non-technical users. In essence, when the door contact comprised of magnet 21 and switch 23 indicates that the door is closed, the security alarm system will become armed. Conversely, when magnet 21 and switch 23 of the door contact indicate that the door is opened, the security alarm system will become disarmed. Sensor command unit 30, despite its simple appearance, provides all the means necessary for a user to enter various modes of operation, bypass zones, disable inadvertent alarms, make emergency telephone calls, etc.

The indicators on illuminated display 34 on sensor command unit 30 provide much information to a user. The READY light is typically a unicolor LED that is green in color. When the READY light is ON (illuminated), this indicates to the user that all zones of the monitored premises are secure and the system is ready to be armed. When the READY light is flashing, the user knows that at least one zone is open. In order to determine which zone is open, the user can count the number of flashes and refer to the zone list which is typically provided on the security panel. Finally, when the READY light is OFF, this is indicative that a second entry door, which can optionally be connected to the system, is not secured. If there are two entry doors connected in the system, the other door must be closed before the system can be armed.

The ARMED light is typically a red LED. When the red ARMED light is ON (illuminated) this is indicative that the security alarm system is indeed armed. A blinking ARMED light with siren 50 sounding, indicates that the security alarm system is in an active alarm. A blinking ARMED light, with no siren sounding, indicates that an alarm condition has been stored in memory. In other words, an alarm had been issued but has either been silenced or timed out. In order for the user to determine the actual zone that caused the alarm condition, the user can count the number of flashes and refer to the zone list which is typically placed on the security panel. In order to clear any alarm activity in alarm memory, a user can press SILENCE button 42.

The yellow STAY light will turn ON (illuminated) to indicate that the security alarm system is armed in the STAY mode, thereby allowing free movement throughout the premises, while maintaining perimeter protection. The red FIRE light will flash to indicate that the system is in a fire alarm condition. This feature obviously will only be utilized when a smoke or fire detector is connected to the security alarm system. The user will be taught that if a fire is in progress, as indicated by a flashing red FIRE light, they should evacuate the premises immediately.

The yellow TBL light will illuminate and siren 50 will pulse to indicate to a user that a system trouble is present. Additionally, if zone(s) have been bypassed, the TBL light will illuminate steadily. Trouble conditions can include AC power failure, low battery, communication failure, telephone line cut, siren trouble, etc. The number of times that siren 50 pulses can be made to correspond to a numbered list of troubled conditions to assist the user in identifying the particular trouble being indicated. LED 56 is typically a green fight and indicates to the user that AC power is present. If LED 56 is not illuminated, the system is running on backup battery power.

STAY button 36 is pressed by a user to arm the system in a mode wherein at least one authorized person remains inside the protected premises. Perimeter devices such as windows and doors will remain protection, while interior protected devices such as motion sensors will become de-activated, allowing free movement throughout the interior portions of the protected premises. AWAY button 38 will be pressed by a user when exiting the premises at times when no authorized person remains in the interior of the protected premises. The system will be fully armed with all perimeter and interior sensors and detectors activated.

AWAY button 38 is pressed by a user to arm the system in a mode wherein no authorized person remains inside the premises when a person exits. In such a scenario, the security alarm system will become fully armed with all perimeter and interior devices activated.

While STAY button 36 and AWAY button 38 have proven effective in permitting a user to arm the security alarm system in a desired mode, other techniques are also readily available. For instance, in instances where a user has a doorchain, the system can be made to arm in an AWAY MODE when the chain is not coupled whereas the arming can be in the STAY mode if the chain is engaged. Other techniques will also become readily apparent to those skilled in the art.

BYPASS button 40 has been optimally designed to perform multiple tasks. If a user is attempting to arm the system with open zones that cannot be immediately repaired, BYPASS button 40 can be pressed to temporarily remove the open zones from the system. In order to remind the user that this bypass function has occurred, siren 50 will beep and TBL light on illuminated display 34 will steadily illuminate. When BYPASS button 40 is utilized for bypassing open zones, the user may still press either STAY button 36 or AWAY button 38 to arm the security alarm system in a desired manner. BYPASS button 40 can also be used to test the security alarm system. If BYPASS button 40 is pressed for a predetermined period of time, a test report will be generated and sent to the central monitoring station. If the test fails, siren 50 will beep and the TBL light on illuminated display 34 will flash. Additionally, BYPASS button 40 can be pressed for a longer period of time to conduct a "walk test" of the protected premises. The walk test, which is commonly known to installers, can be terminated by pressing SILENCE button 42.

SILENCE button 42 can be utilized to silence a fire alarm, silence system troubles, and view system troubles. Additionally, SILENCE button 42 can be utilized to remove certain digital keys from the system and to test for proper functioning of motion sensor 54. These two later functions will be described in more detail below.

Figure 4:
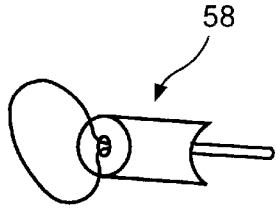
FIG. 4 is a schematic illustration of an electronic key utilized in accordance with the present invention.

If a user depresses fire emergency button 44, the fire department is immediately contacted by the central station. Similarly, if a user depresses police emergency button 46, the police department is immediately contacted. Finally, if a user depresses auxiliary emergency button 48, a separate directly dialed entity can be immediately contacted. In most installations, auxiliary emergency button 48 directly dials the central monitoring station; however, this button can also be programmed to dial the user's work place, a relative, etc. Electronic keyhole 52 is utilized to read information from digital key 58, as shown in FIG. 4. Although more than one digital key can be enrolled to provide data to the security alarm system of the present invention, there will typically only be one "master" digital key. The unique operations of digital key 58 will be described in greater detail below.

Motion sensor 54, which is preferably a passive infrared (PIR) sensor serves three distinct functions. First, motion sensor 54 gathers activity information which provides the security alarm system with data that is used to ensure proper use of the system and prevent user errors. For instance, if a user presses AWAY button 38, opens and closes the door, yet does not leave, motion sensor 54 will sense the users presence in the protected premises and automatically default to STAY mode arming, thereby preventing an unnecessary false alarm. Obviously, additional sensors can be installed, either on sensor command unit 30 or elsewhere, to assist in the decision making process of whether a user remains inside the premises. Motion sensor 54 also acts as an independent intrusion protection device. For instance, when the security alarm system is armed in an AWAY mode, motion sensor 54 provides intrusion protection for an extended range. The detection of an intruder will result in a corresponding central station report and an audible alarm. Motion sensor 54 can also be utilized to provide anti-tamper protection by utilizing a PIR that has side beams intended to prevent an intruder from walking along the wall toward sensor command unit 30. If an intruder is detected in the anti-tamper zone, the system will be put into a lock-out state for a period of several minutes, during which time the system may only be disarmed by a digital key 58 as set forth in FIG. 4. It is presumed that an intruder would not be in possession of an operable digital key.

The security system of the present invention provides a vast array of new changes and operational modes, yet is simple for the user to operate. In one instance, a user will be arming the system while leaving the premises with no other family members or authorized personnel remaining in the home. If the green READY light is illuminated, the system is immediately ready to be armed. The user will simply depress AWAY button 30, to commence an exit delay period (typically sixty seconds) for which the user to close the door and exit the premises. If the door has not been closed within sixty seconds of pressing AWAY button 38, the security alarm system will revert back to a disarmed state. As a further advantage of the security alarm system of the present invention, if motion sensor 54 detects movement within the premises within sixty seconds of the depression of away button 38, the system will automatically revert to STAY mode thereby providing perimeter protection only.

If upon leaving the premises with no other family members or authorized personnel remaining in the home, the user notices that the green READY light is blinking, this is indicative of a zone that is faulted. The READY light on illuminated display 34 will blink a number of times corresponding to the number of the open zone. Optimally, the user will secure the faulted zone. If not, the user may bypass the faulted zone in the flowing manner. First, the user will depress BYPASS button 40. The TBL light on illuminated display 34 will illuminate steadily. At this point, the user may press either STAY button 36 or AWAY button 38. The system will then become appropriately armed, with the faulted zones bypassed. The user will know that bypass zones are unprotected. In instances where there is an optional second entry door coupled to the system, it is important that the user not arm the system with the other entry door unsecured. Thus, if a user approaches sensor command unit 30 while exiting, and notices the READY light off, this is indicative of the second door being unsecured. The user should go to the second door and secure it properly before exiting the premises.

The user may also arm the system while remaining inside the premises. In such situations, the user will depress STAY button 36 and close the door from inside the premises. In such a scenario, perimeter protection will become active and the interior protection will be off. Once again, various zones can be bypassed if desired. The same sequence of events are utilized to arm the security alarm system of the present invention when the user operating sensor command unit 30 exits the premises, but a family member remains home.

The security alarm system of the present invention also provides an advantageous "lost key" mode. In any alarm system that is operational from the closing and opening (or locking and unlocking) of a door, it is essential that if means for closing and opening (or locking and unlocking) the door fall into the wrong hands, the system needs extra security. In the event that the keys to entry door 10 are lost or stolen, the system of the present invention may still be used by arming it in its lost key mode. In lost key mode, the system may be armed as usual, however, opening door 10 will not disarm the system. Instead, the system may only become disarmed by inserting a programmable digital key 58 in electronic keyhole 52 on sensor command unit 30. In order to enter lost key mode, a user will simultaneously hold down STAY button 36 and AWAY button 38 for a predetermined period of time. The TBL light will begin to pulse to indicate that the aforementioned buttons were correctly depressed. At this point, the security alarm system of the present invention may be armed as usual, however, it may only be disarmed with the use of digital key 58. The system will remain in lost key mode until deactivated. Furthermore, a user can confirm that the security alarm system is in lost key mode by depressing SILENCE button 42. After SILENCE button 42 is depressed, the TBL light will pulse a predetermined number of times. The user can depress silence button 42 and stop the display.

When in lost key mode, a user will arrive at home to an armed system, open entry door 10, and enter the premises. At this point, siren 50 will sound to remind the user to disarm the system. The user must insert digital key 58 in electronic keyhole 52 within a predetermined time frame, or the alarm will sound. Once the user changes locks on the door, the security alarm system can be returned to normal operation by once again holding down STAY button 36 and AWAY button 38 for a predetermined period of time. The TBL light will stop flashing at this point.

Except for when the security alarm system of the present invention is in the lost key mode, the disarming of the system is passive. When a user returns home, the simple opening of entry door 10 will automatically disarm the system. The red ARMED light on illuminated display 34 will go out, and the green READY light on illuminated display 34 will illuminate. If an alarm condition had occurred while the user was away, the red ARMED light will be flashing, and siren 50 will emit a sound. Under such conditions, the user should proceed with caution if they suspect that an intruder may still be on the premises. The system may also always be disarmed by utilizing digital key 58.

If an alarm occurs while a user is at home, sensor command unit 30 can also be utilized to silence the alarm. When the alarm becomes active, siren 50 will sound and red ARMED light on illuminated display 34 will flash. If the user suspect that an intruder is on the premises, they should leave immediately and call authorities from an outside telephone line. However, if the user desires to immediately silence the alarm, digital key 58 can simply be inserted into electronic keyhole 52. At this stage, the red ARMED light will continue to flash the number of the zone on which the alarm occurred. The user should investigate that zone before depressing silence button 42 to clear the alarm memory. The silencing of an alarm that occurs while a user is away is similar, although the user should proceed with even greater caution under such circumstances.

Optionally, a smoke or fire detector can be coupled to the security alarm system of the present invention. If a fire is detected, siren 50 will sound a distinct pulsing tone and the FIRE light on illuminated display 34 will flash. Obviously, if a fire is in progress, the user should evacuate the premises immediately and call the fire department from an outside phone. Conversely, if there is no evidence of a fire, the user may either depress SILENCE button 42 or insert digital key 58 in electronic keyhole 52. At that point, siren 50 will silence and the FIRE indicator on illuminated display 34 will light steadily. The user should preferably always investigate a fire alarm. Thus, in order to determine which device went into alarm, the user should check all active fire detectors. The fire detector that caused the alarm should be illuminated. Once it is determined which smoke detector is in alarm, the user can again depress SILENCE button 42 to reset the smoke detector. If all smoke or fire detectors have been reset properly, the fire indicator on illuminated display 34 should go out in approximately thirty seconds. If the FIE indicator does not go out, the user can depress SILENCE button 42 again in a few minutes since smoke alarms sometimes require several attempts to deactivate. If the FIRE light still does not go out, the user should immediately contact its central monitoring station for service. In order to meet all regulatory requirements, the security alarm system of the present invention constantly monitors fire zones to ensure the connections to the protective devices are in good working order. If a problem develops in any fire zone, a system trouble will display. Siren 50 will activate and the TBL light on illuminated display 34 will blink seven times. If such a fire-zone trouble is indicated, the user will be instructed to immediately contact the central monitoring station for service.

As described above, many functions and modes of the security alarm system of the present invention can be overridden by utilizing a uniquely coded digital key 58. While one such key will be designated the "master" key, it is typically necessary to provide a user with multiple keys for various authorized family members. However, such digital keys often become lost or stolen. Thus, there must be provided a means for enrolling and removing digital keys from the system. Both functions can be performed at sensor command unit 30. In order to enroll additional electronic keys, the user will first make certain that the system is disarmed. The master key will then be inserted into electronic keyhole 52 within eight seconds after that, a new key to be enrolled should be inserted into electronic keyhole 54. The new key is then removed and has been enrolled to operate the security alarm system of the present invention. The newly enrolled key can easily be tested by arming the system in the stay mode and utilizing the new key to disarm the system. The above process can obviously be repeated to enroll a plurality of electronic keys.

In the event that a non-master key becomes lost or stolen, the following procedure can be utilized to remove all non-master keys from the system. With the system disarmed, the master key should be inserted until a beep from siren 50 is heard. After the beep, SILENCE button 42 should be depressed for a predetermined period of time, typically about four seconds. In order to ensure that the process was correctly performed, another beep from siren 50 will be heard. At this stage, all non-master keys had been removed from the system. In order to re-enroll non-lost keys, the aforementioned system of enrolling keys can be re-implemented.

Figure 5:
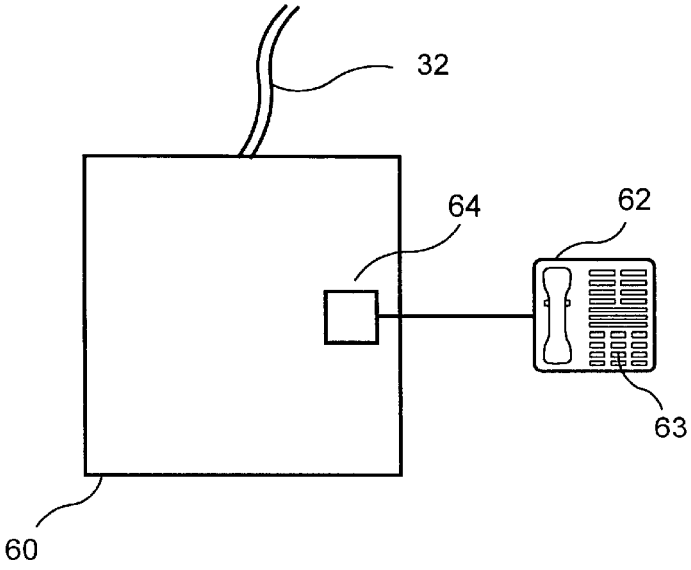
FIG. 5 is a schematic illustration of a control panel and telephone interconnection utilized in accordance with the present invention.

Turning next to FIG. 5, an alarm control panel 60 is shown which has been coupled to a standard telephone 62 having a keypad 63. Wires 32 are shown as the interconnection between panel 60 and sensor command unit 30 for instances where the two share a common power source. However, separate power sources can be utilized. A dual-tone, multi-frequency (DTMF) decoder 64 has also been provided. The interconnection shown in FIG. 5 permits a user to silence an inadvertent alarm by entering a disarm code on keypad 73. DTMF decoder 74 can interpret these touchtone signals to disarm the system. Instead of utilizing standard telephone 72 and its keypad 73, a hidden kill switch, a keypad, a fingerprint reader, a retinal scanner, a wireless keyfob, a swipecard, etc. could also be provided for when the user desires to disarm the system.

It will be apparent from the foregoing description that the present invention provides a new and improved security alarm system which is easily installed and provides all the functions and features of keypad-activated security alarm systems. While a specific layout of various visual indicia, etc. has been provided, many variations may be utilized. For instance, the LEDs may be of various colors and, in fact, could be combined as a tri-color LED indicative of varying status. Moreover, any of the LEDs described herein can be replaced, or supplemented, by other indicator means including a voice enunciator, a liquid crystal display, and the like.

Wile there has been shown and described what is presently considered to be the preferred embodiments of this invention, it will be obvious to those skilled in the art that various changes and modifications may be made without departing from the broader aspects of this invention. It is, therefore, aimed in the appended claims to cover all such changes and modifications as fall within the true scope and spirit of the invention.

We claim:

1. A security system which may be selectively armed or disarmed for monitoring a protected premises comprising:

an entry door for permitting ingress to said protected premises from the outside of said entry door and egress from said protected premises from the inside of said entry door;

means for selectively closing and opening said entry door; and a switch having a first state indicative of said entry door being in a closed position and a second state indicative of said entry door being in an opened position wherein, when said switch is in said first state, said security system is armed and, when said switch is in said second state, said security system is disarmed.

2. The security system of claim 1 wherein said switch is a door contact.

3. The security system of claim 2 wherein said door contact includes a magnetic Reed switch.

4. The security system of claim 2 wherein said door contact includes an electron beam.

5. The security system of claim 1 wherein said first state further comprises a first sub-state wherein only perimeter protection components of said security system are armed and a second sub-state wherein both said perimeter protection components and interior protection components of said security system are armed.

6. The security system of claim 1 further comprising:

a user-activated panic button in proximity to said door.

7. The security system of claim 1 further comprising:

means for disabling an inadvertent alarm.

8. The security system of claim 7 wherein said means for disabling an inadvertent alarm comprises a kill switch.

9. The security system of claim 7 wherein said means for disabling an inadvertent alarm comprises a keyfob.

10. The security system of claim 7 wherein said means for disabling an inadvertent alarm comprises a telephone keypad coupled to a DTMF decoder.

11. The security system of claim 7 wherein said means for disabling an inadvertent alarm comprises a keypad.

12. The security system of claim 7 wherein said means for disabling an inadvertent alarm comprises a coded digital key.

13. A method of selectively arming or disarming a security system having an entry door to a protected premises, said entry door having means for selectively closing and opening said entry door, said method comprising the steps of:

determining the position of said entry door as being in a closed position or an opened position;

arming said security system when said entry door is in said closed position; and disarming said security system when said entry door is in said opened position.

14. The method of claim 13 wherein said arming step further comprises the sub-steps of:

arming only perimeter protection components of said security system when an authorized person remains inside the protected premises; and arming both said perimeter protection components and interior protection components of said security system when no authorized person remains inside the protected premises.

15. The method of claim 13 further comprising the step of:

disabling an inadvertent alarm.

16. The method of claim 15 wherein said disabling step comprises the sub-steps of:

activating a user-controlled disabling means; and moving said entry door to said unlocked position.

17. The method of claim 16 wherein said disabling means comprises a kill switch.

18. The method of claim 16 wherein said disabling means comprises a keyfob.

19. The method of claim 16 wherein said disabling means comprises a telephone keypad coupled to a DTMF decoder.

20. The method of claim 16 wherein said disarming means comprises a keypad.

21. The method of claim 16 wherein said disarming means comprises a coded digital key.

22. A method of selectively arming or disarming the security system having an entry door to a protected premises, said entry door having means for selectively closing and opening said entry door, said method comprising the steps of:

determining the position of said entry door as being in a closed position or an opened position;

disarming said security system when said entry door is in said opened position;

establishing a time period commenced when said entry door is placed in said closed position;

monitoring the interior of said protected premises during said time period to determine the presence of a person; and arming said security system when said monitoring step detects the presence of said person.

23. The method of claim 22 further comprising the step of:

disabling an inadvertent alarm.

24. The method of claim 23 wherein said disabling step comprises the sub-sets of:

activating a user-controlled disabling means; and moving said entry door to said unlocked position.

25. The method of claim 24 wherein said disabling means comprises a kill switch.

26. The method of claim 24 wherein said disabling means comprises a keyfob.

27. The method of claim 24 wherein said disabling means comprises a telephone keypad coupled to a DTMF decoder.

28. The method of claim 24 wherein said disabling means comprises a keypad.

29. The method of claim 24 wherein said disabling means is a coded digital key.

30. A security system that may be selectively armed or disarmed for monitoring a protected premises comprising:

an entry door for permitting ingress to said protected premises from the outside of said entry door and egress from said protected premises from the inside of said entry door;

means for selectively closing and opening said entry door; and a processing means capable of issuing a first signal indicative of said entry door being in a closed position and a second signal indicative of said entry door being in an opened position wherein said first signal arms said security system and said second signal disarms said security system.

31. The security system of claim 30 wherein said first signal can be utilized to arm either only perimeter protection components of said security system or both said perimeter protection components and interior protection components of said security system.

32. The security system of claim 30 further comprising:

a user-activated panic button in proximity to said door.

33. The security system of claim 30 further comprising:

means for disabling an inadvertent alarm.

34. The security system of claim 33 wherein said means for disabling an inadvertent alarm comprises a kill switch.

35. The security system of claim 33 wherein said means for disabling an inadvertent alarm comprises a keyfob.

36. The security system of claim 33 wherein said means for disabling an inadvertent alarm comprises a telephone keypad coupled to a DTMF decoder.

37. The security system of claim 33 wherein said means for disabling an inadvertent alarm comprises a keypad.

38. The security system of claim 33 wherein said means for disabling an inadvertent alarm comprises a coded digital key.

39. A security system which may be selectively armed or disarmed for monitoring a protected premises comprising:

an entry door for permitting ingress to said protected premises from the outside of said entry door and egress from said protected premises from the inside of said entry door;

an alarm panel remotely located from said entry door and capable of issuing an alarm signal when said security system is armed;

means for selectively closing and opening said entry door; and a switch having a first state indicative of said entry door being in a closed position and a second state indicative of said entry door being in an opened position wherein, when said switch is in said first state, said security system is armed and, when said switch is in said second state, said security system is disarmed.

40. The security system of claim 39 wherein said switch is a door contact.

41. The security system of claim 40 wherein said door contact includes a magnetic Reed switch.

42. The security system of claim 40 wherein said door contact includes an election beam.

43. The security system of claim 39 wherein said first state further comprises a first sub-state wherein only perimeter protection components of said security system are armed and a second sub-state wherein both said perimeter protection components and interior protection components of said security system are armed.

44. The security system of claim 39 further comprising:

a user-activated panic button in proximity to said door.

45. The security system of claim 39 further comprising:

means for disabling an inadvertent alarm.

46. The security system of claim 45 wherein said means for disabling an inadvertent alarm comprises a kill switch.

47. The security system of claim 45 wherein said means for disabling an inadvertent alarm comprises a key fob.

48. The security system of claim 45 wherein said means for disabling an inadvertent alarm comprises a telephone keypad coupled to a DTMF decoder.

49. The security system of claim 45 wherein said means for disabling an inadvertent alarm comprises a keypad.

50. The security system of claim 45 wherein said means for disabling an inadvertent alarm comprises a coded digital key.

51. A method of selectively arming or disarming a security system having an entry door to a protected premises, said entry door having means for selectively closing and opening said entry door, and an alarm panel remotely located from said entry door and capable of issuing an alarm signal when said security system is armed, said method comprising the steps of:

determining the position of said entry door as being in a closed position or an opened position;

arming said security system when said entry door is in said closed position; and disarming said security system when said entry door is in said opened position.

52. The method of claim 51 wherein said arming step further comprises the sub-steps of:

arming only perimeter protection components of said security system when an authorized person remains inside the protected premises; and arming both said perimeter protection components and interior protection components of said security system when no authorized person remains inside the protected premises.

53. The method of claim 51 further comprising the step of:

disabling an inadvertent alarm.

54. The method of claim 53 wherein said disabling step comprises the sub-steps of:

activating a user-controlled disabling means; and moving said entry door to said unlocked position.

55. The method of claim 54 wherein said disabling means comprises a kill switch.

56. The method of claim 54 wherein said disabling means comprises a key fob.

57. The method of claim 54 wherein said disabling means comprises a telephone keypad coupled to a DTMF decoder.

58. The method of claim 54 wherein said disabling means comprises a keypad.

59. The method of claim 54 wherein said disabling means comprises a coded digital key.

60. A security system that may be selectively armed or disarmed for monitoring a protected premises comprising:

an entry door for permitting ingress to said protected premises from the outside of said entry door and egress from said protected premises from the inside of said entry door;

an alarm panel remotely located from said entry door and capable of issuing an alarm signal when said security system is armed;

means for selectively opening and closing said entry door; and a processing means capable of issuing a first signal indicative of said entry door being in a closed position and a second signal indicative of said entry door being in an opened position wherein said first signal arms said security system and said second signal disarms said security system.

61. The security system of claim 60 wherein said first signal can be utilized to arm either only perimeter protection components of said security system or both said perimeter protection components and interior protection components of said security system.

62. The security system of claim 60 further comprising:

a user-activated panic button in proximity to said door.

63. The security system of claim 61 further comprising:

means for disabling an inadvertent alarm.

64. The security system of claim 63 wherein said means for disabling an inadvertent alarm comprises a kill switch.

65. The security system of claim 63 wherein said means for disabling an inadvertent alarm comprises a key fob.

66. The security system of claim 63 wherein said means for disabling an inadvertent alarm comprises a telephone keypad coupled to a DTMF decoder.

67. The security system of claim 63 wherein said means for disabling an inadvertent alarm comprises a keypad.

68. The security system of claim 63 wherein said means for disabling an inadvertent alarm comprises a coded digital key.

* * * * *